US007465175B2

(12) United States Patent
Crippa et al.

(10) Patent No.: US 7,465,175 B2
(45) Date of Patent: Dec. 16, 2008

(54) SYSTEM FOR UNMATING A CONNECTOR PAIR

(75) Inventors: Roberto Crippa, Costa Masnaga (IT); Roberto Maltecca, Pozzuolo Martesana (IT); Roberto Omati, Gessate (IT)

(73) Assignee: ALCATEL, Paris (FR)

( * ) Notice: Subject to any disclaimer, the term of this patent is extended or adjusted under 35 U.S.C. 154(b) by 0 days.

(21) Appl. No.: 11/523,553

(22) Filed: Sep. 20, 2006

(65) Prior Publication Data

US 2007/0254508 A1 Nov. 1, 2007

(30) Foreign Application Priority Data

Apr. 26, 2006 (IT) ..... MI2006A0824

(51) Int. Cl.
*H01R 13/62* (2006.01)

(52) U.S. Cl. ..... 439/157; 439/160

(58) Field of Classification Search ..... 439/157, 439/160, 152, 65, 660, 79
See application file for complete search history.

(56) References Cited

U.S. PATENT DOCUMENTS 5,035,634 A * 7/1991 Hasircoglu et al. ..... 439/157
5,178,553 A * 1/1993 Hatagishi et al. ..... 439/157
5,312,262 A * 5/1994 Bublitz ..... 439/160
5,393,238 A * 2/1995 Saito ..... 439/157
5,446,394 A * 8/1995 Cassidy ..... 324/762
5,641,296 A * 6/1997 Larabell et al. ..... 439/342
6,572,391 B2 * 6/2003 Mochizuki et al. ..... 439/157
6,913,474 B2 * 7/2005 Mikhail et al. ..... 439/157
7,001,200 B2 * 2/2006 Yoshie ..... 439/358
2006/0003616 A1 * 1/2006 Narui et al. ..... 439/157
2007/0161275 A1 * 7/2007 McBroom et al. ..... 439/160

* cited by examiner

*Primary Examiner*—Hien Vu
(74) *Attorney, Agent, or Firm*—Sughrue Mion, PLLC

(57) ABSTRACT

The present invention relates to a system for unmating a board-to-board high pin count connector pair, said connector pair comprising two connector elements adapted to be mated together and fixedly mounted on two respective boards; said connector pair is so configured that the two boards are substantially parallel when the two connector elements are mated together; the system according to the present invention comprises at least two cam elements rotatably mounted on a first board on opposite sides with respect to the corresponding connector element and rotation means adapted to manually rotate the cam elements so as to apply a force to a second one of the two boards when the two connector elements are mated together, thereby unmating the connector pair.

21 Claims, 3 Drawing Sheets

SYSTEM FOR UNMATING A CONNECTOR PAIR

FIELD OF THE INVENTION

The present invention relates to a system for unmating a board-to-board high pin count connector pair according to the preamble of claim 1.

This application is based on and claims the benefit of Italian Patent Application No MI2006A000824 filed on Apr. 26, 2006, which is incorporated by reference herein.

BACKGROUND OF THE INVENTION

A connector pair of this kind is found, for example, in the family of products called GIG-Array manufactured by FCI. Such a connector pair comprises two connector elements adapted to be mated together; the two connector elements are adapted to be fixedly mounted on two respective boards; moreover, such a connector pair is so configured that the two boards are substantially parallel when its two connector elements are mated together. Such a board-to-board high pin count connector pair requires the application of a great force for both being mated and unmated.

The mating operation is quite easy to carry out, because it is fairly easy to apply a great force when pushing the two connector elements one against the other. On the contrary, the unmating operation is not easy at all, because it is quite difficult to apply a great force when pulling apart the two elements.

The GIG-Array products' technical documentation describes a special procedure for unmating the connector pair, which essentially requires that the two connector elements be rocked side-to-side while exerting the pulling force; such a manoeuvre is clearly quite delicate and requires much skill to avoid damaging the connector elements and their electrical pins.

The problems connected with the unmating operation become even worse when the connector elements are in their normal operating condition, i.e. mounted on boards, called PCBs [Printed Circuit Boards]. As a matter of fact, the pulling force must be applied to the boards, which in turn will transmit it to the connector elements; it follows that there is a great risk of damaging the boards and/or the mounting between the boards and the connector elements.

These problems are generally solved by relying on the skill and training of the staff in charge of the installation and repair of electronic apparatuses, who therefore must handle their boards.

SUMMARY OF THE INVENTION

The object of the present invention is to provide a better solution to the above-described problems, which requires less personnel's skill and training. Such an object is achieved by the system for unmating a connector pair having the features set out in independent claim 1.

The present invention is based on the idea of applying the unmating force through manual rotation of cam elements; by so doing, the force can be controlled easily as well as distributed and localized appropriately.

Further advantageous features of the present invention are set out in the claims directly or indirectly depending on claim 1, which are to be considered as an integral part of the present description.

According to a further aspect, the present invention also relates to a connector pair incorporating said unmating system; the technical features of said connector pair are set out in independent claim 12 and in the claims directly or indirectly depending on claim 12, which are to be considered as an integral part of the present description.

BRIEF DESCRIPTION OF THE DRAWINGS

The present invention will become more apparent from the following description and from the annexed drawings, wherein.

Figure 1:
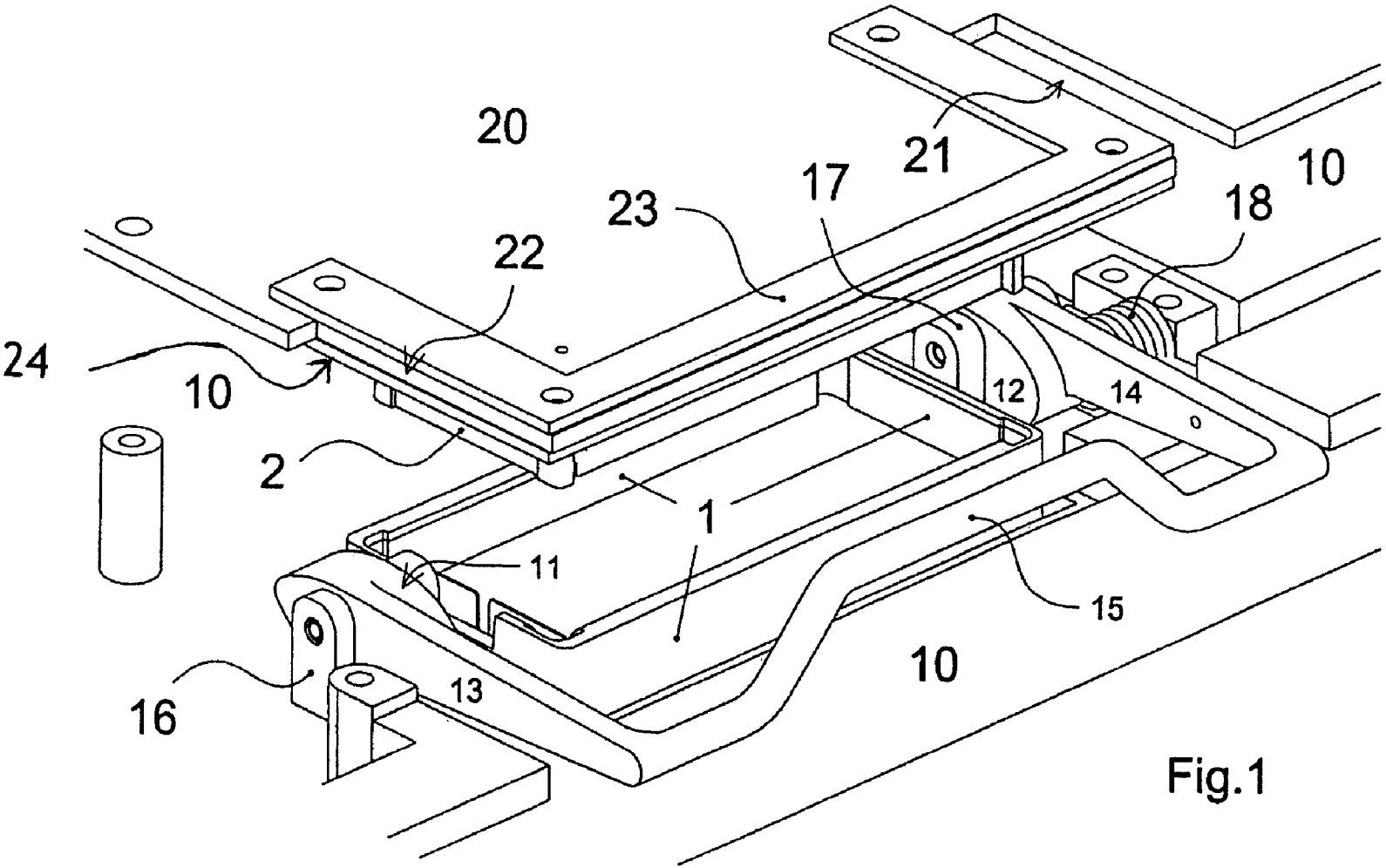
FIG. 1 shows a first three-dimensional view of two boards with an embodiment of the system according to the present invention.

Said description and said drawings are only to be considered as non-limiting explanatory examples.

BEST MODE FOR CARRYING OUT THE INVENTION

The drawings show two boards 10 and 20; the board 20 is positioned higher than the board 10. On the boards 10 and 20, two connector elements 1 and 2 are fixedly mounted which belong to the same GIG-Array connector pair manufactured by FCI.

A GIG-Array connector pair is an electrical device used for creating a plurality of electrical connections between two boards; to this purpose, it is provided with a plurality of electrical pins; the connector pair is so configured that the two boards are substantially parallel when its two connector elements are mated together. Therefore, such a connector pair provides an electrical as well as a mechanical connection between the two boards.

As stated above, mating and unmating such a connector pair requires a great force.

The drawings show a mechanical device, in one piece, which comprises two cam elements 11 and 12, two levers 13 and 14, and a handle 15; the cam element 11 is integral with a first end of the lever 13, and the cam element 12 is integral with a first end of the lever 14; both levers 13 and 14 essentially consist of two substantially parallel metal rods joined at the respective second ends by a handle 15. This mechanical device is rotatably mounted on the board 10 through two hinge elements 16 and 17; in particular, the cam element 11 is rotatably mounted on the hinge element 16, and the cam element 12 is rotatably mounted on the hinge element 17.

Figure 3:
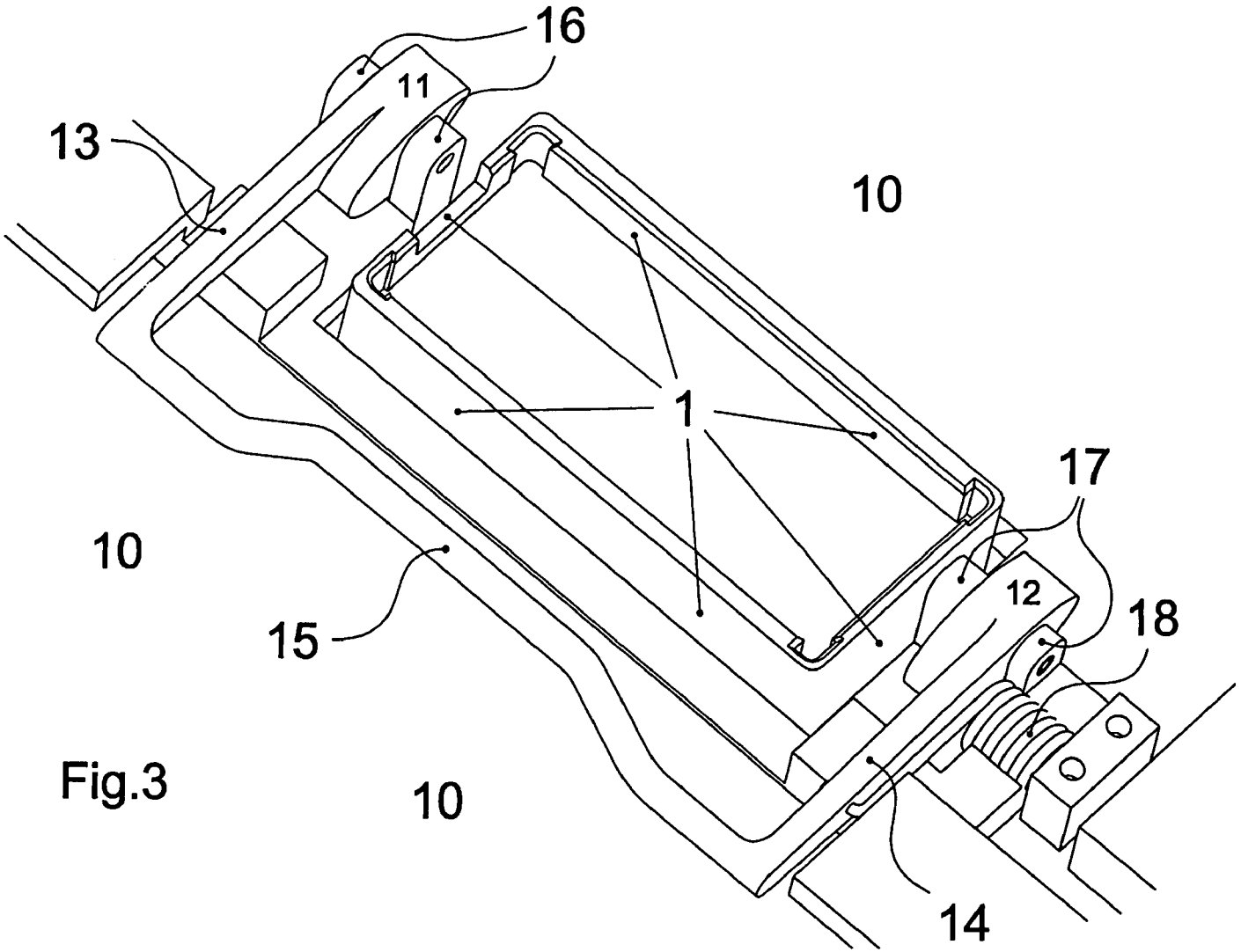
FIG. 3 shows a third three-dimensional view of one of the boards of FIG. 1.

The hinge elements 16 and 17 are fixedly mounted on the board 10 on opposite sides with respect to the connector element 1; in particular, as clearly shown in FIG. 3, the connector element 1 has a substantially rectangular shape (when observed in the mating direction), and the hinge elements 16 and 17 are adjacent to the two shorter sides of the connector element 1 in intermediate positions of said shorter sides.

The hinge elements 16 and 17 create one axis of rotation for the cam elements 11 and 12, the rods 13 and 14, and the handle 15, and therefore for the entire mechanical device; this axis of rotation is parallel to the board 10 and to an axis of symmetry of the connector element 1. In the illustrated example, said axis of rotation almost coincides with said axis of symmetry, in particular being located at a distance of about 2 mm; however, depending on the dimensions of the cams, said distance may be greater up to, for example, 5 mm; thanks to this small distance, the points of the cams can be aligned properly with the axis of symmetry of the connector element 1.

Figure 2:
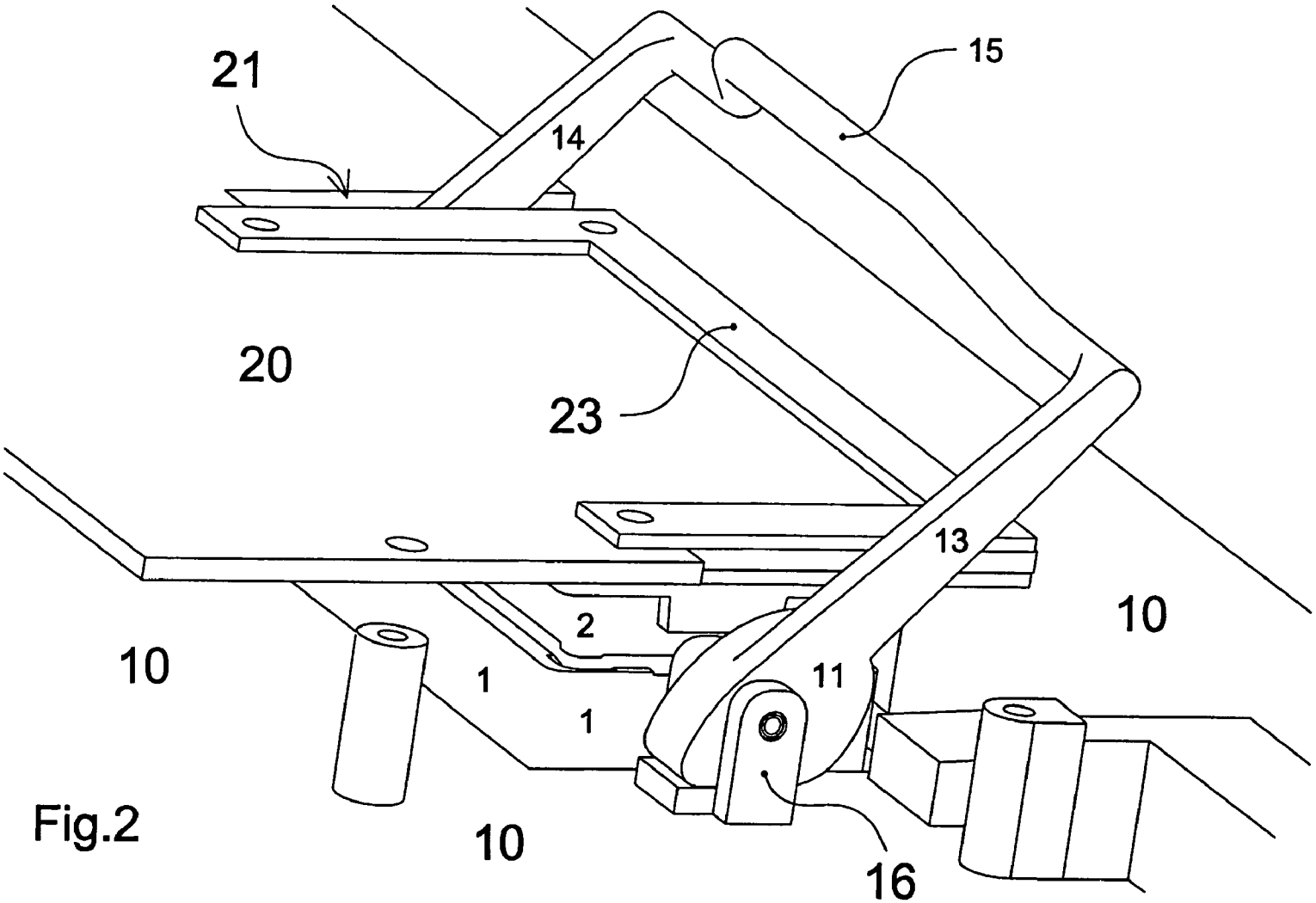
FIG. 2 shows a second three-dimensional view of the boards of FIG. 1.

When the handle 15 is operated manually, the levers 13 and 14 rotate together with the cam elements 11 and 12, as shown in FIG. 2; thus a force is applied to the board 20 which consists of a first force component exerted by the cam element 11 on a first side with respect to the connector pair and a second force component exerted by the cam element 12 on a second side with respect to the connector pair; said force is substantially perpendicular to the board 10 and therefore also to the board 20, as well as central to the connector elements 1 and 2. This causes the connector pair to be unmated; said force is controlled easily and distributed and localized appropriately; the best results are obtained by suitably selecting the length of the levers 13 and 14 as well as the shapes of the cams of the elements 11 and 12.

In the illustrated system example, the cam elements 11 and 12 are shaped in such a way that the connector pair is unmated by turning the two levers 13 and 14 by an angle being much smaller than 90°, in particular approximately 45°; thus it is not necessary to leave much free space above the boards 10 and 20 for the rotation of the levers 13 and 14 and of the handle 15. Still with reference to the illustrated system example, the angular travel of both levers 13 and 14 is limited mechanically; as shown in FIG. 2, the cam elements 11 and 12 are so shaped as to abut against a corresponding surface of the hinge elements 16 and 17 after having completed a rotation of about 45° (the same rotation is performed by the levers 13 and 14).

There may also be reinforcement elements mounted on the board 20, so that the cam elements 11 and 12 apply the force directly to the reinforcement elements and indirectly to the board; this, in particular, reduces the risk of said force damaging the board 20 locally. As shown in the drawings, there is a first metallic U-shaped element 23 on the upper side and a second metallic U-shaped element 24 on the underside, and the board 20 is fastened between the two U-shaped elements by means of screws.

In the system example illustrated in the drawings, there is a rest position of both levers 13 and 14, in particular, wherein said levers are substantially parallel to the board 10 (FIG. 1); there are also means, in particular a spring 18, which are adapted to keep and return the levers 13 and 14 automatically in their rest position when not operated.

The handle 15 essentially consists of a metal rod and has a special profile that makes it easy to grip the handle when the mechanical device is in its rest position; in fact, it comprises at least one bend, preferably in its central area, which allows the fingers to be inserted between the handle 15 and the board 10.

In the illustrated example, the connector element 2 is located close to one side of the board 20, more specifically close to a corner of the same. In order to allow one of the two levers, in particular the lever 14, to rotate, the board 20 has an inner cutout 21; as to the lever 13, the board 20 has a lateral cutout 22, although this is not strictly necessary.

In general, the unmating system according to the present invention is characterized in that it comprises at least two cam elements rotatably mounted on a first one of the two boards on opposite sides with respect to a corresponding first one of the two connector elements and rotation means adapted to manually rotate the cam elements so as to apply a force to a second one of the two boards when the two connector elements are mated together, thereby unmating the connector pair.

The rotation means may be manufactured in many different ways and not necessarily as a single, simple mechanical device as in the example shown in the drawings; for instance, the two levers may not be joined by a handle, or the two levers may transmit a rotary motion to both cam elements through transmission means, or the two levers may carry out a translation motion while imparting a rotary motion to the cam elements through suitable transmission elements.

As said, the rotation angle of the levers is a parameter which must be taken into account in order to avoid wasting valuable space inside electronic apparatuses; therefore, the levers rotate by an angle being preferably smaller than 90°, more preferably comprised between 30° and 60°, even more preferably of about 45°; consequently, the cam elements and/or the rotation means must be designed appropriately; in the illustrated example, the cams of the cam elements are shaped in such a way as to cause the connector pair to unmate after a rotation of 45°; as an alternative, for instance, the levers may rotate of just 45° whereas the cam elements may be rotated of 90° through suitable transmission means comprised in the rotation means.

As stated above, the rotation of the levers might be opposed by one of the two boards; this does not happen when the distance between the levers is greater than the width of the upper board in the corresponding area. In general, it will be necessary to provide an inner cutout in the upper board for each lever; of course, in those cases wherein a lever moves in the area corresponding to an edge of the upper board, the cutout may be lateral or even absent.

The unmating system according to the present invention may be incorporated in a connector pair, thereby improving its performance; this is a further aspect of the present invention.

In general, such an improved connector pair is characterized in that it comprises at least two cam elements rotatably mounted on a first one of its two connector elements on opposite sides and means adapted to manually rotate the cam elements so as to apply a force to a second one of its connector elements when said two connector elements are mated together, thereby unmating the connector pair.

All other features described above in connection with the unmating system also apply directly to the connector pair.

As to the possible use of hinge elements, these shall typically be integral with or fastened to one of the two connector elements.

Of course, the reinforcement elements on the boards will no longer be necessary, because the cam elements will act directly on the connector elements. However, when designing the connector elements it will be necessary to obtain a suitable strength in those positions of the connector elements wherein the cam elements operate.

The invention claimed is:

1. System for unmating a board-to-board high pin count connector pair, said connector pair comprising:

two connector elements adapted to be mated together, said two connector elements being fixedly mounted on two respective boards, said connector pair being so configured that said two boards are substantially parallel when said two connector elements are mated together and said connector pair being mounted on said two respective boards such that the direction of connection is substantially perpendicular to the planes of the two respective boards, said system comprising:

at least two cam elements rotatably mounted on a first one of said two boards on opposite sides with respect to a corresponding first one of said two connector elements, and rotation means adapted to manually rotate said cam elements so as to apply a force to a second one of said two boards when said two connector elements are mated together, thereby unmating said connector pair;

wherein the rotation means comprise two rotary levers that are positioned substantially parallel to said first and second boards when the levers at rest position when not operated and adapted to manual operation and said second board has at least one cutout to allow at least one of said two levers to rotate.

2. System according to claim 1, wherein said two cam elements are mounted in intermediate positions of sides of said first connector element.

3. System according to claim 1, wherein said two cam elements are adapted to rotate substantially about a same axis of rotation being preferably substantially parallel to said first board.

4. System according to claim 3, wherein said axis of rotation is substantially parallel to and preferably substantially coinciding with an axis of symmetry of said first connector element.

5. System according to claim 1, wherein said two levers are connected to each other by a handle.

6. System according to claim 1, wherein said cam elements and said rotation means are so configured that said connector pair is unmated by rotating said two levers by an angle being smaller than 90°, preferably comprised between 30° and 60°, more preferably of about 45°.

7. System according to claim 1, comprising spring means adapted to keep and return said two levers automatically in said rest position when not operated.

8. System according to claim 1, wherein said two cam elements are integral with said two levers, respectively.

9. System according to claim 1, comprising at least one reinforcement element, preferably a metallic one, mounted on said second board so that said cam elements apply a force directly to said reinforcement element and indirectly to said second board.

10. System according to claim 1, wherein said second board has at least one cutout in an intermediate position along the length of an edge of said second board to allow at least one of said two levers to rotate.

11. System according to claim 1, wherein said two boards are printed circuit boards.

12. Connector pair, in particular a board-to-board high pin count connector pair, comprising:

two connector elements adapted to be mated together, said two connector elements being adapted to be fixedly mounted on two respective boards, said connector pair being so configured that said two boards are substantially parallel when said two connector elements are mated together, and said connector pair being mounted on said two respective boards such that the direction of connection is substantially perpendicular to the planes of the two respective boards;

said connector pair comprising:

at least two cam elements rotatably mounted on a first one of said two connector elements on opposite sides, and means adapted to manually rotate said cam elements so as to apply a force to a second one of said two connector elements when said two connector elements are mated together, thereby unmating said connector pair;

wherein the means adapted to manually rotate said cam elements comprises two rotary levers that are positioned substantially parallel to said first and second boards when the levers at rest position when not operated and adapted to manual operation and the board on which said second connector element is mounted has at least one cutout to allow at least one of said two levers to rotate.

13. Connector pair according to claim 12, wherein said two cam elements are mounted in intermediate positions of sides of said first connector element.

14. Connector pair according to claim 12, wherein said two cam elements are adapted to rotate substantially about a same axis of rotation being preferably substantially parallel to said first board.

15. Connector pair according to claim 14, wherein said axis of rotation is substantially parallel to and preferably substantially coinciding with an axis of symmetry of said first connector element.

16. Connector pair according to claim 12, wherein said two levers are connected to each other by a handle.

17. Connector pair according to claim 12, wherein said cam elements and said rotation means are so configured that said connector pair is unmated by rotating said two levers by an angle being smaller than 90°, preferably comprised between 30° and 60°, more preferably of about 45°.

18. Connector pair according to claim 12, comprising spring means adapted to keep and return said two levers automatically in said rest position when not operated.

19. Connector pair according to claim 12, wherein said two cam elements are integral with said two levers, respectively.

20. Connector pair according to claim 12, wherein said board on which said second connector element is mounted has at least one cutout in an intermediate position along the length of an edge of said board to allow at least one of said two levers to rotate.

21. Connector pair according to claim 12, said two boards are printed circuit boards.

* * * * *